United States Patent [19]

Young

[11] Patent Number: 4,706,429

[45] Date of Patent: Nov. 17, 1987

[54] PERMANENT NON-REMOVABLE INSULATING TYPE CONCRETE WALL FORMING STRUCTURE

[75] Inventor: David A. Young, Glen Ellyn, Ill.

[73] Assignee: Young Rubber Company, Naperville, Ill.

[21] Appl. No.: 799,932

[22] Filed: Nov. 20, 1985

[51] Int. Cl.[4] ..... E04B 2/00

[52] U.S. Cl. ..... 52/309.12; 52/426; 52/564; 52/698

[58] Field of Search ..... 52/426, 427, 428, 562, 52/563, 564, 565, 568, 715, 698, 712, 594, 309.12

[56] References Cited

U.S. PATENT DOCUMENTS

| | | | |
|---|---|---|---|
| 994,027 | 5/1911 | O'Beirne | 52/568 |
| 2,181,698 | 11/1939 | Langenberg | 52/564 |
| 4,019,298 | 4/1977 | Johnson | 52/594 |
| 4,180,956 | 11/1980 | Gross | 52/563 |
| 4,223,501 | 9/1980 | De Lozier | 52/565 |
| 4,263,765 | 4/1981 | Maloney | 52/309.11 |
| 4,416,097 | 11/1983 | Weir | 52/594 |
| 4,439,967 | 4/1984 | Deilenberg | 52/309.12 |

FOREIGN PATENT DOCUMENTS

| | | | |
|---|---|---|---|
| 924922 | 4/1973 | Canada | 52/426 |
| 1484217 | 5/1969 | Fed. Rep. of Germany | 52/426 |
| 928002 | 11/1947 | France | 52/564 |
| 1580113 | 7/1969 | France | 52/594 |

*Primary Examiner*—Henry E. Raduazo

*Attorney, Agent, or Firm*—Charles F. Meroni, Jr.

[57] ABSTRACT

A modular synthetic plastic concrete form structure which comprises a pair of modular concrete impervious forming panels each comprised of a series of modular concrete forming sections stacked on top on one another and also disposed in end-to-end relation. The sections each having means on its upper and lower edges and its opposite vertical edges for interlocking the sections in engagement with one another. The panels each being comprised of a synthetic plastic and the panels are positioned in spaced opposed relation. Tie slots are provided in the opposed sections positioned in longitudinally spaced relation along the upper and lower edges. Synthetic plastic ties are provided with each having opposite enlarged tie ends retainingly engaged in the tie slots securing the sections in opposed spaced relation. Modular transversely extending closure panels are mounted between the opposed panels providing end closures for confining poured concrete within the form defined by the opposed panels and the end closure panels. Modular attachment means are provided between opposed faces of the opposed panels and opposite ends of the closure panels to secure the assemblage in unitary relation to define a concrete form. The reinforcing ties each are secured in permanent embedded assembly at opposite ends with the synthetic plastic opposed panels and also with the concrete when poured and hardened in the thus provided form to provide an insulated concrete wall with the synthetic plastic panels being permanently attached to the exterior of the concrete wall.

33 Claims, 14 Drawing Figures

PERMANENT NON-REMOVABLE INSULATING TYPE CONCRETE WALL FORMING STRUCTURE

BACKGROUND OF THE INVENTION

Field of the Invention

The present invention relates to a new and improved synthetic plastic concrete forming system. The present invention also concerns a new and improved combination of a synthetic plastic concrete form structure and concrete wall ties for permanent assembly with a concrete structure formed in the form. Still another part of the invention relates to a new and improved synthetic plastic concrete form structure having ties for rigidifying the same and with shock absorbers between forming sections and the ties to enable the concrete to be poured into the form to minimize the impact applied to the ties.

According to other features of my invention, I have developed a new and improved cushioning structure for cushioning the impact received by the synthetic plastic concrete wall ties whereby the wall structure has a reduced thickness at a point immediately below where the end of each wall tie engages in its slot provided in the synthetic plastic wall panel so that when poured concrete strikes the wall tie, the wall tie can move downwardly at the area where the thickness of the panel has been reduced to cushion the impact of the concrete upon the wall tie and the panels without cracking and/or breaking the panels.

According to still other important features of my invention, I have provided a new and improved castellation structure for enabling the panels to be stacked upon each other and to resist leakage through the castellation joint should a heaving occur between the panels whereby one panel might be caused to be slightly lifted relative to the other panel to which it is engaged.

Yet another feature of my invention is to provide a new and improved castellation structure for joining stacked panels together where concrete dams are built into the castellation to inhibit concrete leakage exteriorly of the joined panels.

Yet another important feature of my invention concerns a new and improved form closure panel for use with my synthetic plastic concrete forming system whereby the closure panel can be inserted between a pair of confronting panels at any given point along the length of the panels and whereby the closure panel serves to contain concrete within the concrete forming structure.

Still another important feature of my invention is to provide a new and improved synthetic plastic concrete forming system where its components and particularly the panels can be shipped in compact knock-down form to minimize shipping costs.

Still another feature of my invention is to provide a new and improved connector structure for connecting a closure panel with opposed concrete panels to provide a modular synthetic plastic concrete forming system.

Yet still another feature of my invention concerns a new and improved connecting structure for joining ends of synthetic plastic concrete panels in end-to-end relation such that accidental disassembly of the end engaged panels can be resisted.

In the past, it will be appreciated that different types of foamed plastic concrete forming systems have been used in industry and, in this connection, attention is drawn to U.S. Pat. Nos. 3,552,076 and 3,788,020. These patents relate generally to concrete forms formed from low density foamed plastic and polymeric material but where the forms do not possess the improvements herein described and illustrated.

SUMMARY OF THE INVENTION

In a modular synthetic plastic concrete form structure, wherein the improvement comprises a pair of modular concrete impervious forming panels each comprised of a series of modular concrete forming sections stacked on top on one another and also disposed in end-to-end relation, the sections each having means on its upper and lower edges and its opposite vertical edges for interlocking the sections in engagement with one another, the panels being positioned in spaced opposed relation, tie slots in the opposed sections positioned in longitudinally spaced relation along the upper and lower edges, synthetic plastic ties each having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall.

In a modular synthetic plastic concrete form structure, wherein the improvement comprises a pair of modular concrete impervious panels comprised of a series of opposed modular concrete forming sections stacked on top on one another and also disposed in end-to-end relation, the sections each having means on its upper and lower edges and its opposite vertical edges for interlocking the sections in engagement with one another, the panels being positioned in spaced opposed relation, tie slots in the opposed sections positioned in longitudinally spaced rows along the upper and lower edges, synthetic plastic ties arranged in vertically spaced rows along upper and lower edges of the sections, the ties being positioned in vertically spaced horizontally extending rows and the ties having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the ties and the forming sections having heights at substantial variance with respect to one another when the ties are assembled in the rows at upper and lower edges of the forming sections leaving a substantial open area between the upper and lower rows of ties enabling concrete to be rapidly poured between the forming sections with low flow impedance from the ties, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall.

In a modular synthetic plastic concrete form structure, wherein the improvement comprises a pair of modular concrete impervious synthetic plastic forming panels each comprised of a series of opposed modular concrete forming sections stacked on top on one another and also disposed in end-to-end relation, the sections each having longitudinally spaced castellation means including castellation blocks and castellation block receiving cavities on its upper and lower edges along a joint between the sections for enabling superimposed sections to be press-fitted by hand pressure enabling the sections to be vertically stacked upon one another in interlocked assembly, the castellation means having concrete dam means for enabling the stacked sections to be slightly separated relative to one another without creating a leakage path for concrete to seep through the joint between the longitudinally extending edges of the panels, and synthetic plastic concrete form ties securing the spaced opposed panels in assembly together, said dam means comprising a dam block integrally linked at opposite ends to the castellation means in assembly together and a correspondingly shaped dam block cavity, the dam block cavity being shaped for mated press-fitted engagement with the dam block when panels the concrete section forming sections are disposed in superimposed assembly, together the castellation block having a greater height than the dam block to allow the stacked sections to separate slightly along the joint and yet prohibit leakage throughout the joint while the sections are maintained in interlocked assembly.

DESCRIPTION OF THE PREFERRED EMBODIMENTS

Figure 1:
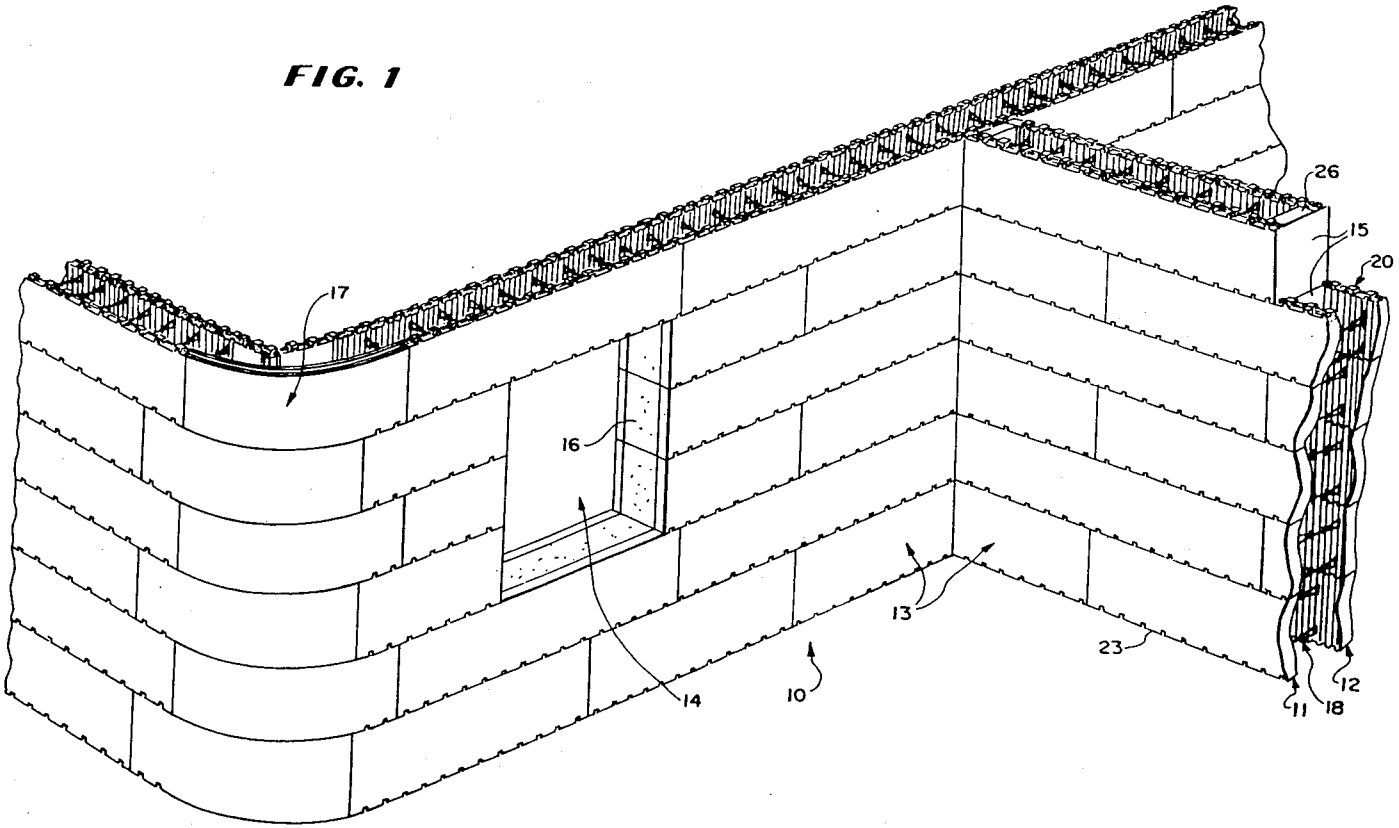
FIG. 1 is an enlarged fragmentary cross-sectional view of a modular foamed plastic concrete form structure embodying important features of my invention.

The reference numberal 10, as seen in FIG. 1, designates generally a modular foamed plastic concrete form structure. The structure that is shown in FIG. 1 is also shown in my co-pending U.S. application for patent entitled: "AN INSULATING NON-REMOVABLE TYPE CONCRETE WALL FORMING STRUCTURE AND DEVICE AND SYSTEM FOR ATTACHING WALL COVERINGS THERETO", Our Ser. No. 799,933 filed 11/20/85 which is co-pending with the present application. The disclosure of my co-pending application is here incorporated by reference.

The structure 10 is comprised of a pair of modular concrete forming panels 11 and 12 which are spaced from one another and which when properly installed serve to act as a form into which concrete may be poured. The panels are each comprised of a series of modular concrete forming sections 13 which are all identical to one another with certain exceptions, as hereafter described. These sections are adapted to be cut and arranged so as to enable window openings 14 to be easily constructed. Cooperable with the panels 11 and 12 are end closure panels 15 which extend transversely between the forming panels 11 and 12 and between the forming sections 13 so as to confine poured concrete. It will further be seen that the window openings 14 are also provided with closure panels 16. All of the panels 11, 12, the sections 13, the closure panels or end pieces 15, the window panels 16 and curved corner panels 17 are comprised of foamed plastic preferably an expandible polystyrene. This material has been found to have unique insulating properties and strength so as to enable concrete walls to be better insulated to impede transmission of heat through a formed wall as will be further described at another point herein.

In order to properly reinforce the concrete forming structure 10, I have developed a new and improved wall tie 18 which is comprised of 20% calcium carbonate filled polypropylene as a preferred embodiment.

My thermal wall system is a whole new concept in energy efficient building technology. The building block sections of expanded polystyrene serve as a permanent form for concrete. This system of construction is for use where energy conservation is for use where energy conservation and speed of construction are important.

Expanded polystyrene or EPS is a closed cell, rigid, lightweight cellular plastic, white in color, that is molded into various shapes with steam and pressure. Thermal wall system panels are made of modified polystyrene. The density of the panels range between 1.7 and 2.0. Typical physical properties of EPS insulation is given in Table 1 below. Like all organic materials, EPS is combustible and should not be exposed to flame or other ignition sources.

TYPICAL PHYSICAL PROPERTIES OF EPS

| Property | | Units | ASTM Test | Density (pcf) 10 | 125 | 15 | 20 |
|---|---|---|---|---|---|---|---|
| Thermal Conductivity | at 25 F. | BTU/(hr) | C177 or | 0-23 | 0-22 | 0-21 | 0-20 |
| K Factor | at 40 F. | (sq ft) (F/in) | C518 | 0-24 | 0-235 | 0-22 | 0-21 |
| | at 75 F. | | | 0-26 | 0-255 | 0-24 | 0-23 |
| Thermal Resistance | at 25 F. | at 1 inch | | 4-35 | 4-54 | 4-76 | 5-00 |
| Values (R) | at 40 F. | thickness | — | 4-17 | 4-25 | 4-55 | 4-76 |
| | at 75 F. | | | 3-85 | 3-92 | 4-17 | 4-35 |
| Strength Properties | | | | | | | |
| Compressive 10% Deformation | | psi | D1621 | 10-14 | 13-18 | 15-21 | 25-33 |
| Flexural | | psi | C203 | 25-30 | 32-38 | 40-50 | 55-75 |
| Tensile | | psi | D1623 | 16-20 | 17-21 | 18-22 | 23-27 |
| Shear | | psi | D732 | 18-22 | 23-25 | 26-32 | 33-37 |
| Shear Modulus | | psi | — | 280-320 | 370-410 | 460-500 | 600-640 |
| Modulus of Elasticity | | psi | — | 180-220 | 250-310 | 320-360 | 460-500 |
| Moisture Resistance | | | | | | | |
| WVT | | perm in | C355 | 12-30 | 11-28 | 09-25 | 06-15 |
| Absorption (vol) | | percent | C272 | less than 2-5 | less than 2-5 | less than 2-0 | less than 1-0 |
| Capillarity | | — | — | none | none | none | none |
| Coefficient of Thermal Expansion | | in/(in) (F.) | D696 | 0-000035 | 0-000035 | 0-000035 | 0-000035 |
| Maximum Service Temperature | | °F. | — | | | | |
| Long term | | | | 167 | 167 | 167 | 167 |
| Intermittent | | | | 180 | 180 | 180 | 180 |

All values based on data available from American Hoechst Corporation ARCO Chemical Company and BASF Wyandotte Corporation The basic building components of my thermal wall system are the two solid 2" panels 11 and 12 of polystyrene connected together with high impact plastic ties 18. The length of the tie 18 determines the width of the concrete wall. Each block or section 13 has male castellations 20 along its top edge or surface 21 and matching female castellations 20' along its under edge 23 (FIG. 1). The blocks or sections 13 are placed one on top of the other and pressed together using simple hand pressure. The castellations mesh together creating a completely smooth surface that is interlocked. The vertical ends of the block or section 13 are tongue 24 and groove 25 (FIG. 10) and interlock as well. The blocks or sections 13 are erected directly on top of footings or on the floor slab, as design dictates. The footings must be level and flat. When placing concrete, particular care should be taken in the first lift to check the horizontal and vertical levels.

Figure 8:
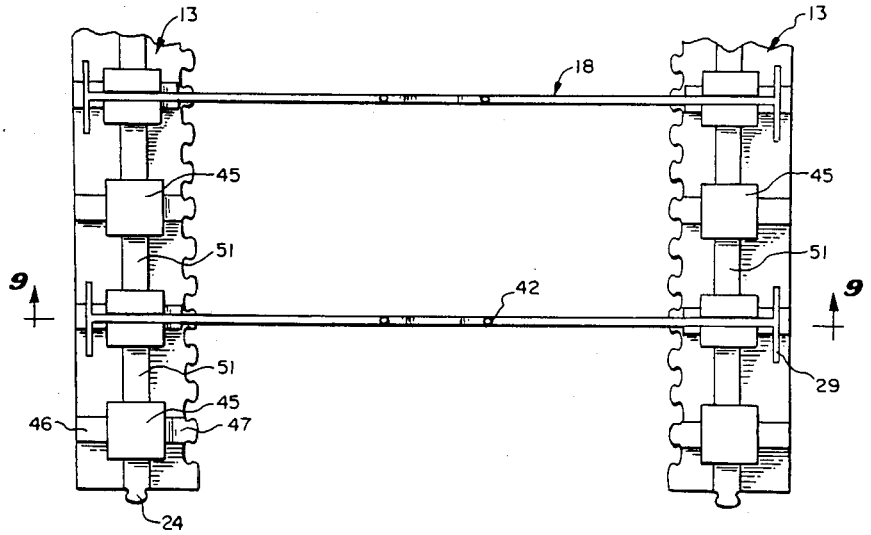
FIG. 8 is a fragmentary top plan view of the concrete form structure shown in FIG. 7.

Each of the end closures 15 vertically extending alternating hooked shaped ribs and grooves generally indicated at 26 which are shaped like and complimentary to hook shaped ribs 27 and hooked shaped grooves 28 (FIG. 8) to enable opposite ends of the end closures 15 to be slid into interlocked assembly with the opposed sections 13, 13. The sections have the ribs 27 and grooves 28 formed integral with the associated section 13 and when set up, the ribs 27 and the grooves 28 on the opposed panels 11 and 12 confront one another.

Figure 2:
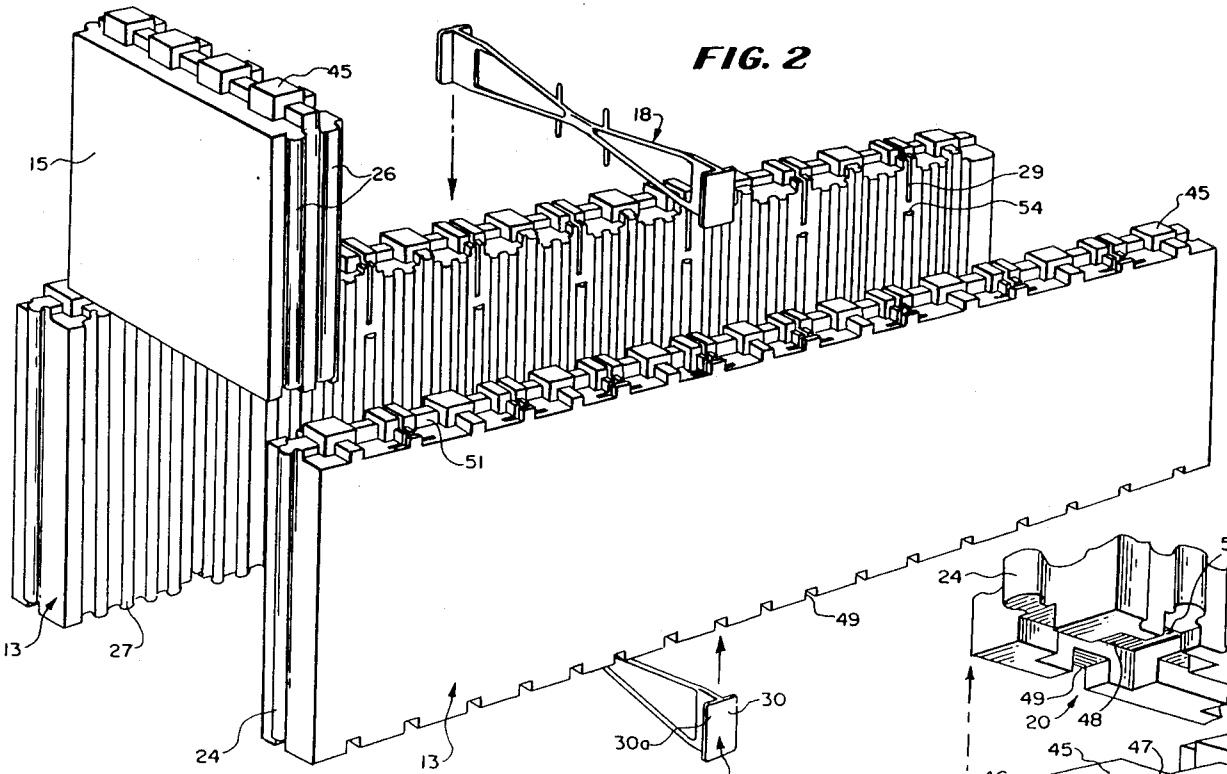
FIG. 2 is an exploded perspective view of my modular foamed plastic concrete form structure showing the manner of assembly of components.

The ties 18 are adapted to coact with upper and lower rows of T-shaped slots 29 which are formed in each of the sections 13. The slot 29 opens on an inner side so that the T-shaped slots oppose one another when two sections 13—13 are placed in opposed relation such as is shown in FIG. 2. The ties 18 are provided with T-shaped tie ends 30—30 which have a configuration that matches the shape of the slots 29 so as to be slideably engageable together when assembled with the sections. The ties 18 when engaged with the opposed sections along their upper and lower edges provide a sturdy concrete form structure.

Figure 4:
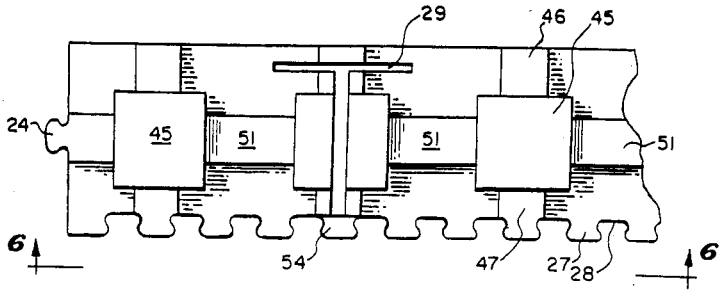
FIG. 4 is an enlarged fragmentary top plan view of a panel for my modular foamed plastic concrete form structure.
Figure 5:
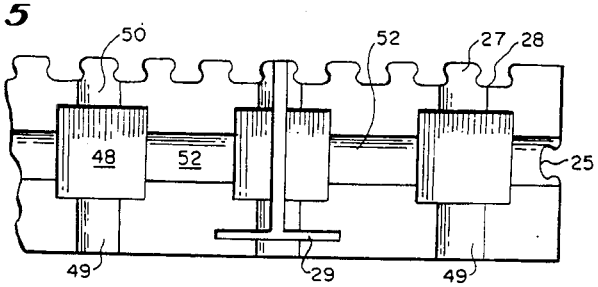
FIG. 5 is an enlarged bottom view of the same panels shown in FIG. 4.
Figure 6:
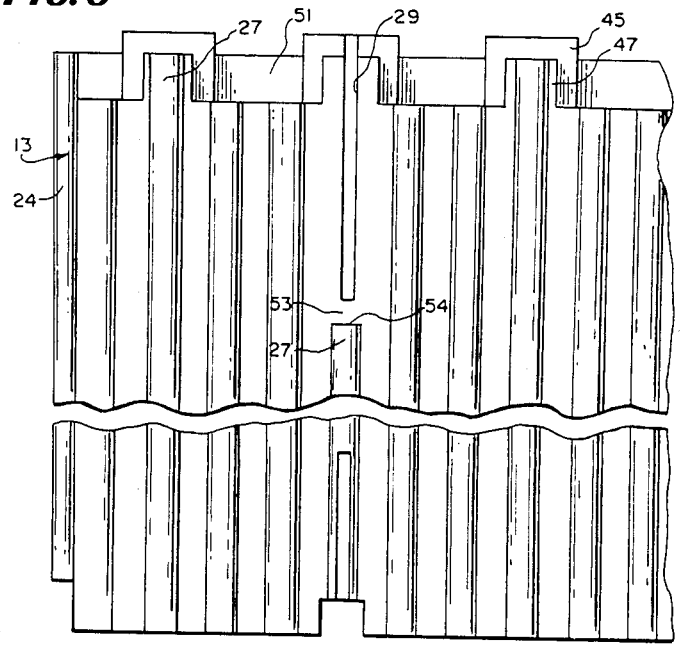
FIG. 6 is an enlarged fragmentary front plan view of a panel structure which is a component of my modular foamed plastic concrete form structure illustrating certain important features of my invention.
Figure 7:
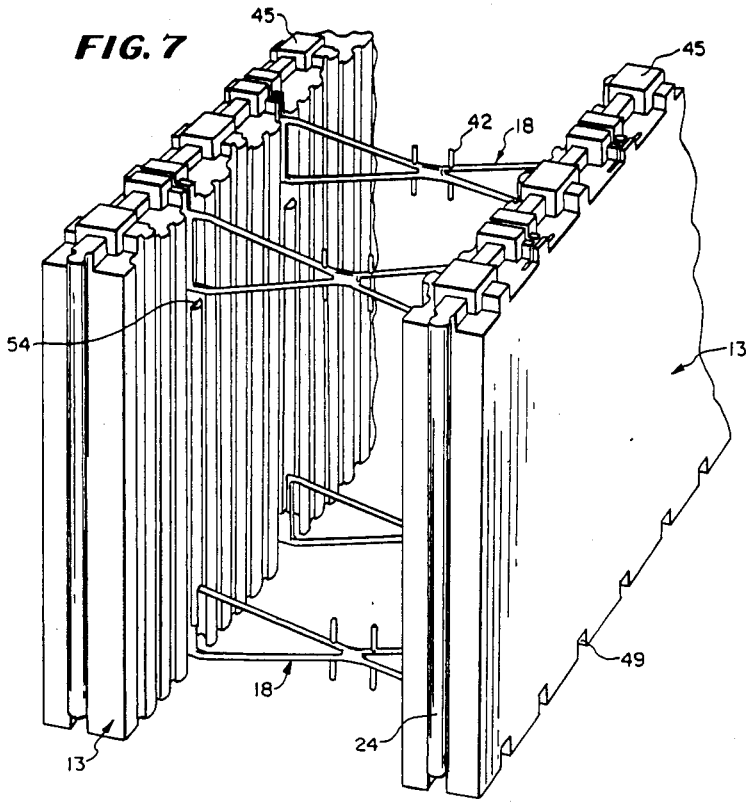
FIG. 7 is an enlarged fragmentary perspective view illustrating the manner in which concrete ties are engaged along upper and lower edges of the panels for securing opposed panels in assembly together.

It will be noted from comparing FIGS. 4 and 5 of my aforesaid co-pending application, that two different types of ties identified as ties 18 and 18' are there disclosed. Only tie 18 is shown here but either one may be used. These ties are essentially identical except that one tie 18' is shorter and can be used where narrower concrete walls are to be formed such as having a thickness of 8". The longer ties 18 are adapted to be used in the formation of concrete walls having a thickness of 10". The length of the ties can be varied as required. The two ties are similar in construction and the differences are pointed out in my other application.

The ties 18 have an intermediate or mid-web section 31', and a pair of triangular truss sections 32 are disposed on opposite ends of the mid-section 31', in integral one piece assembly therewith. The intermediate web section 31' joins the truss sections at the apexes of triangles of the triangular truss sections. As stated, the triangular truss sections 32 and 33 define triangular truss openings 34 and 35. It is these openings that have been created to enable concrete to flow freely through the ties in an unimpeded manner so that the ties will not act as dams to confine the flow of liquid concrete in the molds or forms as the concrete is poured.

The triangular truss sections 32 and 33 terminate in end truss portions 36 and 37 which in turn merge into the T-shaped tie ends 30—30. Each of the tie ends includes a cross piece portion **30*a* and a stem portion 30*b*. The truss sections are further defined by truss legs 38, 39, 40 and 41** which are all preferably of a diameter of approximately 3/16".

The ties 18 are also provided with upstanding fingers 42—42 with a pair of the fingers being mounted on each edge of the tie and more particularly are joined to adjacent truss legs. The fingers 42 coact with the truss legs so as to form V-shaped notches 43 for receiving reinforcing rods 44. It has been found that where the ties are constructed so as to be provided with the fingers 42 defining the notches 43 that the concrete rods 44 can be more fixedly located at the point in time when the liquid concrete is poured into the form so that the reinforcing rods will not bounce and move as the concrete C is poured thereon.

The shorter tie 18' in my co-pending application differs from the tie 18 in that it is only provided with a single pair of upstanding fingers and these fingers extend above and below tie mid-section 47.

The ties 18 and 18' shown in my co-pending application are otherwise identified as the long tie 18 and the short tie 18' are preferably constructed having the following approximated dimensions:

| | Length of Tie | Height of Tie | Thickness of Flat End | Width of Stem of T-shaped End |
|---|---|---|---|---|
| Long Tie | 11" | 2 3/16" | 3/16" | 1 5/16" |
| Short Tie | 9" | 2 3/16" | 3/16" | 1¼" |

| | Width of Intermediate Truss Section | Length of Finger | Diameter of Finger |
|---|---|---|---|
| Long Tie | 1 13/16" | ⅝" | 3/16" |
| Short Tie | 1¼" | ⅝" | 3/16" |

| | Length of Vertical Truss Legs | Length of Diagonal Truss Legs | Diameter of Diagonal Truss Legs |
|---|---|---|---|
| Long Tie | 1¾" | 3 1/16" | 3/16" |
| Short Tie | 1¾" | 2⅜" | 3/16" |

My thermal wall structure introduces a new building product made of expandable polystyrene which serves as a permanent form for concrete construction. This products main advantages are its speed of erection and the very high thermal insulation properties attained (R-Value of 20+).

Similar products have been used extensively in Switzerland, Belgium, France, Germany, Venezuela, Australia and now the United States. It has been in use for nearly 20 years. It is a simple building system: Hollow blocks made of ARCO Dylite Expandable Polystyrene, with a flame retardant additive, are erected "Lego" fashion by means of their toothed tops and grooved bottoms. Plastic ties hold the sides together and the length of the tie determines the width of the cavity or wall, the blocks are interlocked both horizontally and vertically. Once erected, concrete is poured into the cavity of the wall creating an insulated load bearing structure.

My thermal wall building blocks or sections 13 are composed of panels of EPS (Expandable Polystyrene) that are 2" thick, 12" high and 40" or 20" long. The density is nearly twice that of conventional insulation board. A whole range of exterior finishes can be applied. Scores of elastomeric coatings and stucco finishes may be used as well as siding or paneling. Interiors are finished with drywall, plaster, tile or in any other traditional manner.

My thermal wall structure is an advanced system of construction for use where energy conservation (by reduction of thermal transmission) and speed of construction (reduced labor costs) are important.

The inherent low thermal fluctuations ensure that the risk of cracking of any external rendering and internal plaster-work are non-existent. The maximum possible expansion is 0.2 mm/m.

Excellent noise and impact sound reduction is also an important advantage of the Thermal Wall System. Remembering that a difference of 10 dB almost halves the volume of noise. 350 Ka/m2 Thermal Wall 250 mm is at 49 dB.

Expandable Polystyrene does not rot and when used properly in building construction it is not subject to any other kind of deterioration while in service.

Panels of "Dylite" Expandable Polystyrene are 2" thick, 12" high and 40" or 20" long. The horizontally spaced rows of "t" or T-shaped slots 29 are disposed along the top and bottom of each section. T-shaped ends 30-30 of the ties 18 are inserted into the slots 29. These ties 18 hold the sections 13 and the panels 11 and 12 together and also determine the width of the wall. Each blocks or sections 13 have the castellations 20 along its top surface and matching castellations along the underside as previously described. The blocks 13 are placed one on top of the other and pressed together using simple pressure; the castellations mesh together creating a completely smooth surface and solid structure. The blocks are erected directly on top of footings or on a floor slab, as design dictates. The footings must be as level and flat as possible. When pouring concrete, particular care should be taken in the first three feet poured to check the horizontal and vertical levels, this is most important, as small errors and variations in the early levels will be greatly increased in height. The lightness of the blocks or sections 13 and the flexibility of them means erection can be both fast and simple.

It will be appreciated that the vertical height of each section 13 can be of the order of 12¾" which will include the vertical dimension of the male castellations 20. When the panels are interlocked together, the male castellations become imbedded in the castellation cavities and the vertical height of the panel then becomes 12" when measured from between the horizontal joints or seams (FIG. 1) when the sections are in stacked assembly as shown. It will further be appreciated that the closure panels 15 have castellations 20 and castellation cavities 20' which are configurated in the same way as the ones that have been described as being provided for the section 13. The operation of the closure panel castellation structure is the same so that the closure panels can also be stacked and locked together in the same manner as the side sections 13.

For corners, windows, door openings and t-junctions a special made "endpiece" is also made of expandable polystyrene and is inserted into the end of the block. It slides into the block and acts as a bulkhead for concrete. It is held in place by surface corrugations on the insides of the block panels.

The corners are formed by interlocking blocks perpendicular to one another (90°) and inserting endpieces to bulkhead the concrete. With a 10" wall, rounded corners are available by use of my specially made corner block or section 17.

Thermal wall blocks or sections 13 can be cut quickly and easily with any conventional hand saw. Sanding down the edge with a coarse abrasive block ensures a smooth tight fit.

The blocks or sections 13 are stacked to the desired height of 8 to 10 foot and are filled with regular concrete by means of a concrete truck and chute or with a concrete pump. A super plasticizer additive is recommended to aid in flowability of the concrete mix without detriment to the strength of the concrete. The concrete should be placed in "lifts" or layers of 4 foot, at a rate of 8 to 10 foot per hour.

Electric & Plumbing

Water supply lines and conduit for electric can be easily cut into the 2" thickness of the thermal wall, after the concrete has been poured. They are then covered with drywall or plaster. Pipes of greater diameter than 2", such as waste water pipes, should be placed in the wall cavity before the concrete is poured. Completely surrounded by concrete and thermal wall polystyrene, the pipe will be insulated and insensitive to frost even if the building is unheated.

The use of thermal wall blocks or sections 13 in construction makes possible the type of energy-efficient construction that is necessary today (and will be even more so in the future judging from the ever-increasing energy costs).

EPS (Expandable Polystyrene) panels 11 and 12 are connected together with the plastic ties 18 to form building blocks. These blocks interlock horizontally and vertically and are stacked one upon another to a desired height and filled with concrete.

The blocks remain in place after the concrete has been poured and provides the structure with an R-Value of 20.

R-Value means the resistance to heat loss and the R system is a way of rating insulation effectiveness: the higher the R-Value the greater the resistance provided against heat and cold.

T.W.S. blocks are formed from ARCO - "Dylite", a fire retardant EPS, and will not support combustion.

There are no limits to the types of wall coverings, both interior and exterior that may be applied. Generally the exterior is of a cemeticious finish and the interior is plastered or drywalled. Panels may be glued or screwed.

SOME OF THE ADVANTAGES

1. Rated R-20+: Stretches Energy Dollars.
2. Concrete cures under ideal conditions, down to −10 degrees C. and use of the sections 13 operates to extend the building season.
3. By using the sections 13 in block form, heating and air conditioning costs can be reduced by 50%.
4. The sections 13 and the formed blocks are fire retardant and will not support combustion.
5. Sound Proof.
6. Water Repellant.
7. Mold and mildew resistant and rot proof.
8. The sections 13 have no food value and insects cannot digest it.
9. The sections 13 are versatile and can be used both above and below grade for residential, multi-family and commercial construction, as well as high-rise construction.
10. My forms are lightweight and the interlocking procedures enable increased productivity with less construction time.
11. The sections and the formed blocks are air tight and voids and air filtration are virtually eliminated.
12. Wall thickness may vary from 6, 8 or 10" based on length of ties.
13. The rounded corner sections allow for increased design possibilities with no additional framing costs.
14. There is a complete absence of cracking of internal and external finishes and maximum possible expansion is 0.2 mm/m.
15. Use of my concrete forms enable a quicker return on Investment Dollars.

LIMITATIONS (a) Loading:

Thermal wall panels should not be installed under surfaces subject to heavy point loading; the E.P.S. does not add structual integrity to the wall; it simply insulates it.

(b) Solvents:

E.P.S. including thermal wall panels can not be exposed to petroleum-based solvents, fuels or coal tar products and their vapors.

(c) Ultraviolet Degredation:

Prolonged exposure to sunlite (Ultraviolet rays) will cause E.P.S. material to discolor and a dusting of the surface will occur. Wall panels must be covered to prevent degredation.

(d) Flammability:

The E.P.S. material used in forming thermal wall panels has a flame retardant additive but it should be considered combustable when directly exposed to a constant source of flame. It should not be installed near an open flame or other source of ignition. Current model building code requirements should be met for adequate protection.

A test has been made of the exandable form panels 11 and 12 which reveals the improved characteristics of my panels, as follows:

TEST STUDY OF IMPACT MODIFIED POLYPROPYLENE SECTIONS ONLY FOR WINTER USAGE

| PROPERTY | UNIT | ASTM METHOD | PP6100BKR | PP6200BKR |
|---|---|---|---|---|
| Tensile Strength at 73° F. | psi | D638 | 3,900 | 3,600 |
| Elongation at Break | % | D638 | — | — |
| Flexural Strength at 73° F. | psi | D790 | 4,700 | 4,400 |
| Flexural Modulus (tangent) | psi × $10^5$ | D790 | 1.7 | 1.5 |
| Flexural Modulus (1% Secant) | psi × $10^5$ | | 1.6 | 1.4 |
| Izod Impact at 73° F. Notched (½" × ⅛" bar) | ft-lb/in. | D256(1) | 2.0 | 3.2 |
| Izod Impact at 73° F. Unnotched (½" × ⅛" bar) | ft-lb/in. | D256 | 20 | 25 |
| Gardner Impact | in-lb | — | +160 | +160 |
| Heat Deflection Temperature, 264 psi | °F. | D648 | 120 | 115 |
| Heat Deflection Temperature, 66 psi | °F. | D648 | 195 | 190 |
| Specific Gravity | — | D648 | .905 | .905 |

-continued

TEST STUDY OF
IMPACT MODIFIED POLYPROPYLENE
SECTIONS ONLY FOR WINTER USAGE

| PROPERTY | UNIT | ASTM METHOD | PP6100BKR | PP6200BKR |
|---|---|---|---|---|
| Hardness, Shore "D" | — | D2240 | 66 | 65 |
| Melt Flow | g/10 min. | D1238(2) | 6–8 | 4–6 |
| Mold Shrinkage | in/in | — | .016 | .016 |

(1) Method A
(2) Condition "L"
Mold shrinkage is intended as a guide only, as specific shrinkage is affected by part design, mold design, and molding conditions.
The values listed herein are to be used as guides, not as specification limits. Determination of product suitability in any given application is the responsibility of the user.

It will be appreciated that suitable wall coverings and furring strips can be attached to the foam panels 11 and 2 in order to provide different types of decorative coverings, as disclosed in my co-pending appliation, Ser. No. 799,933 filed 11/20/85.

Figure 3:
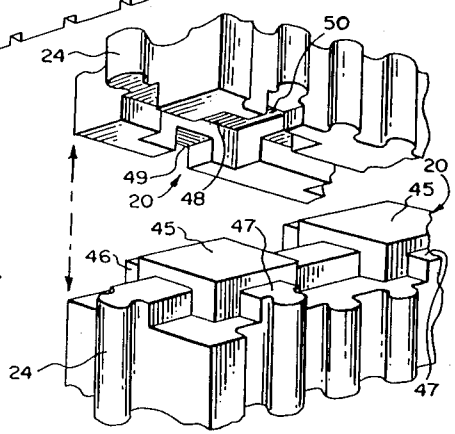
FIG. 3 is an enlarged fragmentary exploded view of a castellation structure for enabling superimposed panels to be press fitted together.

According to other important features of my invention, the castellation structure includes a series of male castellations 20 and female castellations 20' which extend along upper and lower surfaces of each section 13 as illustrated in my patent drawings such as in FIGS. 2 and 3. The castellation structure comprises a main parallel sided block 45 integral with a pair of mini-parallel sided blocks 46 and 47 which project from opposite sides forwardly and rearwardly of the main parallel sided block 45. It will be further perceived that the castellation blocks 45 have a vertical height of ¾". The blocks 45, 46 and 47 all are integral and are spaced along a top edge of each panel 11 and 12. The castellation structure 20 further comprises the female castellations 20' which include a larger parallel sided block cavity 48 and a pair of smaller cavities 49 and 50 linked forwardly and rearwardly of the main cavity 48. These cavities are spaced along the bottom edge of each panel 11 and 12 as seen in FIG. 3. The cavities 48, 49 and 50 have a configuration generally matching the shape of the blocks 45, 46 and 47 for nested press-fitted engagement together to provide a line seam.

Excellent results can be obtained where the main parallel sided block 45 has a vertical dimension of approximately ¾" while side blocks 46 and 47 have a vertical dimension of approximately ½". Still further, each side of the parallel sided block 45 preferably has a dimension of about 1" whereas the parallel sides of the smaller blocks 46 and 47 are preferably about ½". The corresponding surfaces in the cavities 48, 49 and 50 to be mated with the blocks 45, 46 and 47, the cavities are defined by surfaces that are matching to the block surfaces to be engaged therewith. In other words, the cavities constitute an exact negative of the blocks so that a so-called "hand and glove" fit can be obtained between them when they are press-fitted together. Thus, the cavities on the bottom edge of each panel have configurations generally matching the shapes of the blocks for nested press-fitted engagement together.

Figure 11:
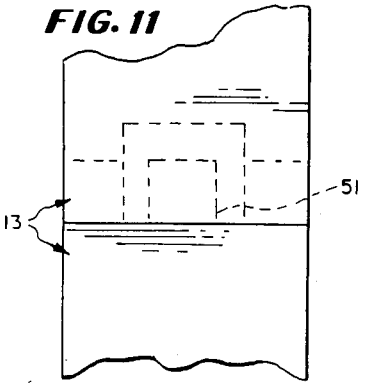
FIG. 11 is a fragmentary end view of a pair of superimposed panels with the dotted lines illustrating the castellation structure for securing the panels in press-fitted assembly together.
Figure 12:
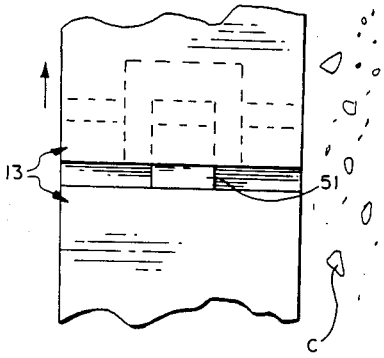
FIG. 12 is a view similar to FIG. 11 only after a concrete pour and where the upper panel has floated in the direction indicated by the arrow and with a bridging dam serving to prohibit concrete leakage through the joint between the panels.

Located between the castellation structures extending along the edges of the panels 11 and 12 are dams or dam blocks or ribs 51. These dams 51 have parallel vertical sides which extend approximately ½" above the top surface of the associated panel and have a width about ½". The dams 51 are linked at opposite ends with the main parallel sided blocks 45—45 and are secured in integral assembly together. These dams are alternated with the main blocks and extend along the length of the top edge of each panel. Corresponding dam or dam block or dam rib cavities 52 extend also along a bottom edge of each of the panels to provide a matching cavity so that the dam 51 can be received into the cavity 52. By providing a combined castellation structure and a dam or dam block arrangement between the panels, a superior concrete impervious seam can be established when the panels are in place for a concrete pour. It has been found that there is some tendency for the footing on which the concrete panels are laid where an unevenness does exist, then the position of the superimposed stacked panels can be out of line. It has been further found that where concrete is poured into the form, there is some tendency for the superimposed panels to "float" (FIG. 12) relative to one another so that the unevenness in the foundation can be compensated for where the superimposed panels become slightly disengaged in a so-called "float" state after concrete has been poured into the form. Where the engaged castellation blocks and cavities are separated up to a distance of ½", the cavities and the blocks engaged therein and the dams 51 and the associated dam cavities 52 all act as a barrier to inhibit the flow of concrete through the impervious seam that exists between the joint (FIGS. 1 and 11) where the superimposed panels are engaged. Other types of structures have been used for attempting to secure superimposed panels together and concrete leakage through the joint has been a common problem that has existed in this art for some time. With my improved castellation structure and my dam structure between the castellations, the leakage can be prevented under normal operating conditions.

Figure 10:
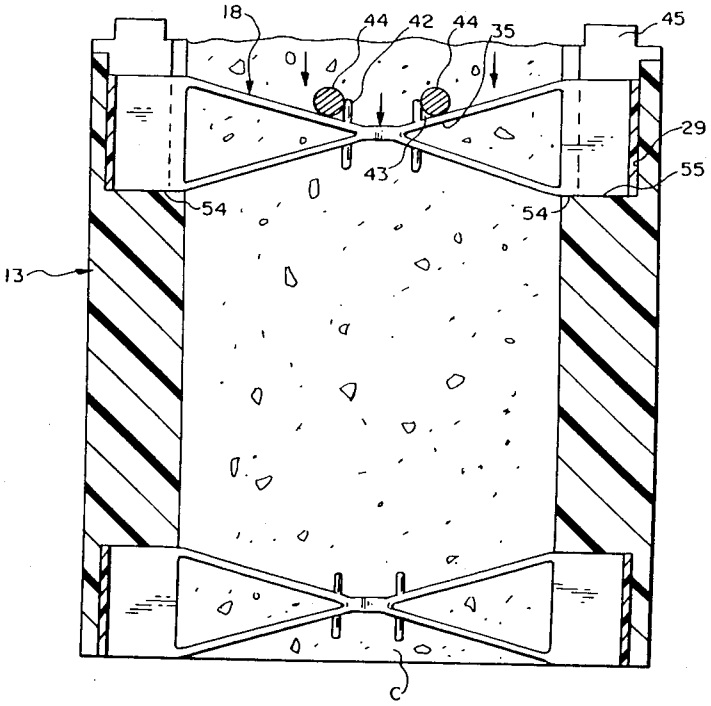
FIG. 10 is a view similar to FIG. 9 only showing a new upper position of a concrete wall tie after concrete has been poured into the forms.
Figure 13:
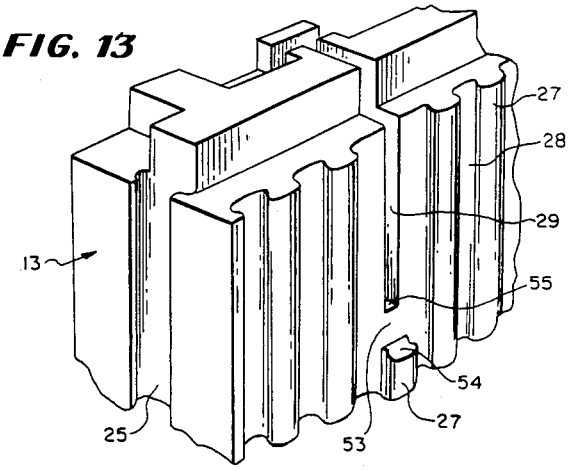
FIG. 13 is an enlarged fragmentary perspective view of an inside surface area of my concrete foamed panel.

In connection with my work on the development of my modular synthetic plastic concrete form structure, I have observed that where concrete is poured into the form such as is illustrated in FIG. 10, that prior to my invention, there was a tendency for the concrete to jostle the concrete ties and in some instances to cause cracks in the polystyrene sections 13 which would damage the panel such that concrete leaks could occur at the cracks. In order to overcome this problem, and in accordance with other important features of my invention, I have found that by reducing the cross-sectional thickness of the panel to provide longitudinally spaced thinner panel areas 53 (FIG. 13) since the rib 29 terminates providing a shock absorbing shoulder 54 that is spaced ½" beneath the lower end of the T-shaped slot shoulder surface 55 on which the tie 18 rests. More specifically, the lower edge of the tie web section 37 is engaged on the shoulder 55 as seen in FIGS. 9 and 10 along with FIG. 13 show the gap relationship and spacing of ½" between the T-shaped lower edge surface 55 and the rib shoulder 54.

Figure 9:
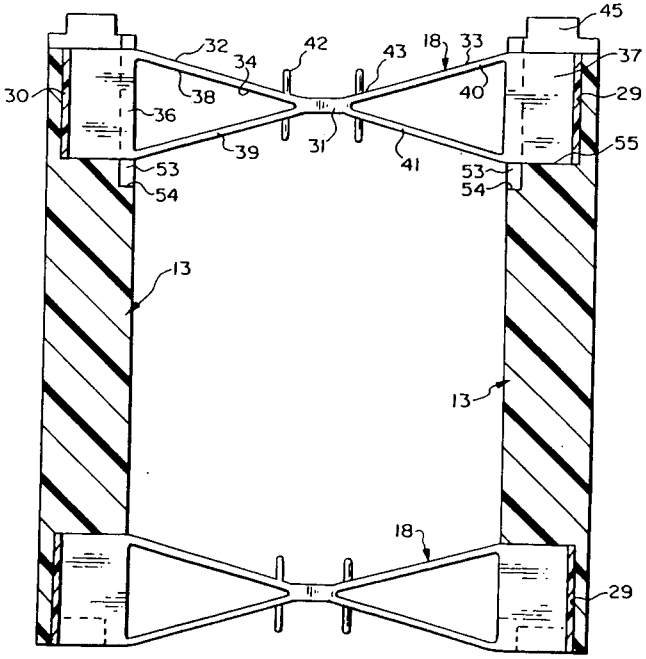
FIG. 9 is a a vertical section taken on line 9—9 looking in the direction indicated by the arrows as seen in FIG. 8.

When the ties are properly positioned to hold the sections 13—13 in assembly together, FIG. 9 depicts the way in which the upper ties 18 are mounted in readiness for a concrete pour. In this connection, the lower edge of the tie rests upon the slot shoulder 55 and a gap relation exists between the lower edge of the tie and the shoulder 54. In FIG. 10, after the reinforcing rods 44 have been placed in position in the tie grooves 43 so as to be carried upon the ties 18, concrete C is poured and the arrows at the top of the tie 18 depict the manner in which the concrete downwardly urges the ties 18 and causes the foam polystyrene to be compacted whereby the bottom surface of the tie slot 53 is compressed in a downward direction. This arrangement enables a dampening of the impact forces received by the ties, and the rib shoulders 54 provide stop means to further dampen the concrete shock forces applied to the ties 18 so that the ties can come to a rest position. As stated before, the reduced thickness of the sections 13 as indicated at 53 and the shoulder 54 act as a shock absorbing dampener to the shock imparted to the ties during a concrete pour. By using this arrangement, I have found that any tendency for the polystyrene section 13 to become cracked at the slots 29 can be substantially eliminated during normal operating conditions. In this respect, it will appreciate that the polystyrene acts like a sponge as the concrete is poured onto the ties so that the polystyrene sections 13 are compacted and the manner of compaction is illustrated by comparing FIGS. 9 and 10.

Figure 14:
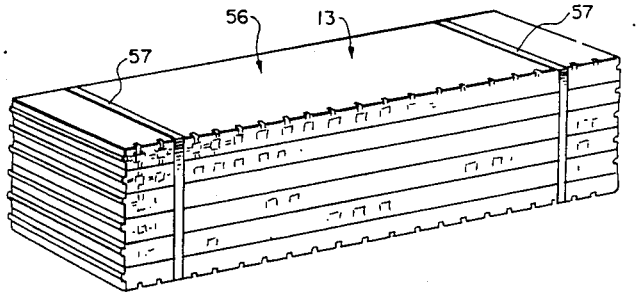
FIG. 14 is an enlarged fragmentary view of a series of compactly oriented superimposed panels disposed in knock-down form for shipment to a customer.

In FIG. 14 I have shown a stacked bundle of sections 13 as indicated at 56. The stacked bundle of sections are secured by straps 57—57 to hold the sections as a bundle in stacked assembly together. In this connection, prior art type foam forms known to me have been shipped in a pre-assembled condition and have required a substantial amount of space where the panels and end closures are formed as a permanent assembly and then shipped to an installation location or where the ties have been formed embedded in the panels so that there is a substantial amount of air space between the panels and these arrangements prohibit the foam structures from being compactly shipped and a minimum of expense. With my new construction, the sections 13 can be shipped in flat stacked form and secured together as bundles 54 in the manner previously discussed and a considerable advantage results to the purchaser of the panels in view of the lower shipping costs.

I claim:

1. In a modular synthetic plastic concrete form structure, wherein the improvement comprises a pair of modular concrete impervious forming panels comprised of a series of opposed modular concrete forming sections stacked on top on one another and also disposed in end-to-end relation, the sections each having means on its upper and lower edges and its opposite vertical edges for interlocking the sections in engagement with one another, the panels being positioned in spaced opposed relation, tie slots in the opposed sections positioned in longitudinally spaced rows along the upper and lower edges, synthetic plastic ties arranged in vertically spaced rows along upper and lower edges of the sections, the ties being positioned in vertically spaced horizontally extending rows and the ties having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the ties and the forming sections having heights at substantial variance with respect to one another when said ties are assembled in the rows at upper and lower edges of the forming sections leaving a substantial open area between the upper and lower rows of ties enabling concrete to be rapidly poured between the forming sections with low flow impedance from the ties, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall.

2. The concrete form structure of claim 1 further characterized by the tie slots being positioned along upper and lower edges of each panel and on its opposite sides an eqidistant modular arrangement so that the panels can be interchangeably used with one another.

3. The concrete form structure of claim 1 further characterized by each of the ties having angular ends being formed in the shape of a T and with the tie slots also being in the shape of a T so that the T-shaped tie ends can be retainingly engaged in the T-shaped tie slots, all of the tie ends and all of the slots being shaped the same so that the ties and the slots are modular and interchangeable.

4. The concrete form structure of claim 1 further characterized by the ties each having triangular tie sections joined at apexes of the triangular tie sections, the tie sections each having triangular openings which are disposed in a common vertical plane for permitting concrete to flow freely through the openings when poured into the form.

5. The form structure of claim 1 where the forming sections and the closure panels are comprised of expanded, closed cell polystyrene having thermal insulation properties having an R-value of 20+.

6. The form structure of claim 1 further characterized by the modular attachment means comprising complimentarily shaped tongues and grooves slidingly engageable and positioned in locked assembly.

7. The form structure of claim 1 further characterized by the modular attachment means comprising complimentarily shaped tongues and grooves slidingly engageable and positioned in locked assembly, the tongues and grooves being hook-shaped to resist being pulled apart in a direction at right angles to bottoms of said grooves.

8. The form structure of claim 1 further characterized by the panel sections each being comprised of expanded, closed cell polystyrene and being 2" thick, 12" high and 20" to 40" long.

9. The form structure of claim 1 further characterized by opposite vertical edges of each of the sections having vertically extending matching hook-shaped tongues and grooves enabling the sections to be engaged in end-to-end interlocked assembly to prevent disassembly except by sliding the engaged tongues and grooves longitudinally of one another.

10. The form structure of claim 1 where the forming sections and the closure panels are comprised of expanded, closed cell polystyrene having a density between 1.7 and 2.0.

11. The concrete form structure of claim 1 further characterized by the forming sections having inner opposing surfaces, the surface being provided with a seriesof vertically extending ribs, ribs being positioned in side by side relation on each surface, and co-acting to create more friction on the inside of the sections as concrete is poured against to hold the form in place.

12. In a modular synthetic plastic concrete form structure, wherein the improvement comprises a pair of modular concrete impervious forming panels comprised of a series of opposed modular concrete forming sections stacked on top on one another and also disposed in end-to-end relation, the sections each having castellation means on its upper and lower edges for enabling superimposed sections to be press-fitted by hand pressure creating a completely smooth surface enabling the sections to be vertically stacked upon one another in interlocked assembly, the panels each being comprised of a synthetic plastic, the panels being positioned in spaced opposed relation, tie slots in the opposed sections positioned in longitudinally spaced rows along upper and lower edges, synthetic plastic reinforcing form ties arranged in vertically spaced rows along upper and lower edges of the sections, the ties being positioned in vertically spaced horizontally extending rows and the ties having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the ties and the forming sectionss having heights at substantial variance with respect to one another when said ties are assembled in the rows at upper and lower edges of the forming sections leaving a substantial open area between the upper and lower rows of ties enabling concrete to be rapidly poured between the forming sections with low flow impedance from the ties, the reinforcing ties each being secured in permanent embedded assembly at opposite ends with the synthetic plastic opposed panels and also with the concrete when poured and hardened in the thus provided form to provide an insulated concrete wall with the synthetic plastic panels permanently attached to the exterior of the concrete wall.

13. The concrete form structure of claim 12 further charactrerized by the tie slots being positioned along upper and lower edges of each panel and on its opposite sides an equidistant modular arrangement so that the panels can be interchangeably used with one another.

14. The concrete form structure of claim 13 further characterized by said means on the upper and lower edges of the panel for interlocking the panel in engagement being modular on each section so that the sections can be interchangeably used with one another.

15. The concrete form structure of claim 12 further characterized by each of the ties having angular ends being formed in the shape of a T and with the tie slots also being in the shape of a T so that the T-shaped tie ends can be retainingly engaged in the T-shaped tie slots, all of the tie ends and all of the slots being shaped the same so that the ties and the slots are modular and interchangeable.

16. The concrete form structure of claim 12 further characterized by the ties each having triangular tie sections joined at apexes of the triangular tie sections, the tie sections each having triangular openings which are disposed in a common vertical plane for permitting concrete to flow freely through the openings when poured into the form.

17. The form structure of claim 12 where the forming sections and the closure panels are comprised of expanded, closed cell polystyrene having thermal insulation properties having an R-value of 20+.

18. The form structure of claim 12 further characterized by the modular attachment means comprising complimentarily shaped tongues and grooves slidingly engageable and positioned in locked assembly, the tongues and grooves being hook-shaped to resist being pulled apart in a direction at right angles to bottoms of said grooves.

19. The form structure of claim 12 further characterized by the modular attachment means comprising at least two complimentarily shaped tongues and at least two grooves slidingly engageable and positioned in locked assembly, the tongues and grooves being hook-shaped to resist being pulled apart in a direction at right angles to bottoms of said grooves.

20. The form structure of claim 12 further characterized by the castellation means each comprising a main parallel sided block integral and a pair of mini-parallel sided blocks projecting from opposite sides of the main parallel sided blocks, which blocks all are integral and are spaced along a top edge of each panel, said castellation means further comprising a series of cavities on a bottom edge of each panel having a configuration generally matching the shape of said blocks for nested press-fitted engagement together.

21. The form structure of claim 12 further characterized by concrete dam means between the castellation means for enabling the stacked sections to be slightly separated relative to one another without creating a leakage path for concrete to seep through the joint between the longitudinally extending secured edges of the panels, and synthetic plastic concrete ties securing the spaced opposed panels in assembly together.

22. The form structure of claim 21 further characterized by said dam means comprising a dam block integrally linked at opposite ends to said castellation means in assembly together and a correspondingly shaped dam block cavity, the dam block cavity being shaped for mated press-fitted engagement with the dam block when panels are disposed in superimposed assembly together.

23. In a modular synthetic plastic concrete form structure, wherein the improvement comprises a pair of modular concrete impervious synthetic plastic forming panels each comprised of a series of opposed modular concrete forming sections stacked on top on one another and also disposed in end-to-end relation, the sections each having longitudinally spaced castellation means including castellation blocks and castellation block receiving cavities on its upper and lower edges along a joint between the sections for enabling superimposed sections to be press-fitted by hand pressure enabling the sections to be vertically stacked upon one another in interlocked assembly, the castellation means having concrete dam means for enabling the stacked sections to be slightly separated relative to one another without creating a leakage path for concrete to seep through the joint between the longitudinally extending edges of the sections, said dam means comprising a dam block integrally linked at opposite ends to said castellation means in assembly together and a correspondingly shaped dam block cavity, the dam block cavity being shaped for mated press-fitted engagement with the dam block when the concrete section forming sections are disposed in superimposed assembly together, the castellation block having a greater height than the dam block to allow stacked sections to separate slightly along said joint and yet prohibit leakage through the joint while the sections are maintained in interlocked assembly.

24. In a modular synthetic plastic concrete form structure, wherein the improvement comprises a pair of modular concrete impervious synthetic plastic forming panels comprised of a series of opposed modular concrete forming sections stacked on top on one another and also disposed in end-to-end relation, means securing the sections together, the sections each having longitudinally spaced castellation means on its upper and lower edges for enabling superimposed sections to be press-fitted by hand pressure enabling the sections to be vertically stacked upon one another in interlocked assembly, concrete dam means between the castellation means for enabling the stacked sections to be slightly separated relative to one another without creating a leakage path for concrete to seep through the joint between the longitudinally extending edges of the panels, the castellation means having a greater vertical height than said dam means enabling the sections to separate slightly at a joint between the stacked sections after concrete has been poured into the concrete form structure and with the castellation means continuing to maintain the sections in interlocked assembly.

25. The form structure of claim 24 further characterized by the castellation means each comprising a main parallel sided block and a pair of mini-parallel sided blocks projecting from opposite sides of the main parallel sided blocks, which blocks all are integral and are spaced along a top edge of each panel, said castellation structure further comprising a series of cavities on a bottom edge of each panel having a configuration generally matching the shape of said blocks for nested press-fitted engagement together, said dam means comprising a dam block integrally linked at opposite ends to said main blocks in assembly together and a correspondingly shaped dam block cavity linked and connected to the main block cavities which are positioned at opposite ends of the dam block, the dam block cavity being shaped for mated press-fitted engagement with the dam block when the concrete forming sections are disposed in superimposed assembly together.

26. The form structure of claim 24 further characterized by said castellation means each comprising a main parallel sided block integral and a pair of mini-parallel sided blocks projecting from opposite sides of the main parallel sided blocks, which blocks all are integral and are spaced along a top edge of each panel, said castellation structure further comprising a series of cavities on a bottom edge of each panel having a configuration generally matching the shape of said blocks for nested press-fitted engagement together.

27. In a modular synthetic plastic concrete form structure, wherein the improvement comprises a pair of modular concrete impervious synthetic plastic forming panels comprised of a series of opposed modular concrete forming sections stacked on top on one another and also disposed in end-to-end relation, the sections each having longitudinally spaced castellation means on its upper and lower edges for enabling superimposed sections to be press-fitted by hand pressure enabling the sections to be vertically stacked upon one another in interlocked assembly, concrete form ties securing the opposed panels together, the ties each having opposite T-shaped tie ends, longitudinally spaced T-shaped slots provided along upper edges of each of the panels with the T-shaped tie ends received therein, the panels having longitudinally spaced thinner panel areas located just beneath lower ends of said T-shaped slots providing shock absorbing means for enabling the shock received by the ties during a concrete pour to be absorbed by the shock absorbing means.

28. The form structure of claim 27 where the forming sections and the closure panels are comprised of expanded, closed cell polystyrene having a density between 1.7 and 2.0.

29. In a modular synthetic plastic concrete form structure, wherein the improvement comprises a pair of modular concrete impervious synthetic plastic forming panels each comprised of a series of opposed modular concrete forming sections stacked on top on one another and also disposed in end-to-end relation, the sections each having longitudinally spaced castellation means including castellation blocks and castellation block receiving cavities on its upper and lower edges along a joint between the sections for enabling superimposed sections to be press-fitted by hand pressure enabling the sections to be vertically stacked upon one another in interlocked assembly, concrete dam means between the castellation means having concrete dam means for enabling the stacked sections to be slightly separated without creating a leakage path for concrete to seep through the joint between the longitudinal secured edges of the panels, synthetic plastic concrete form ties securing the panels in spaced opposed relation, synthetic plastic the ties each having opposite enlarged tie ends retainingly engaged in said tie slots securing the sections in opposed spaced relation, modular transversely extending closure panels mounted between the opposed panels providing end closures for confining poured concrete within the form defined by the opposed panels and the end closure panels, modular attachment means provided between opposed faces of the opposed panels and opposite ends of the closure panels to secure the assemblage in unitary relation to define a concrete form, the reinforcing ties each being secured in permanent embedded assembly at opposite ends with the synthetic plastic opposite panels and also with the concrete when poured and hardened in the thus provided form to provide an insulated concrete wall with the synthetic plastic panels permanently attached to the exterior of the concrete wall, the castellation block having a greater height than the dam block to allow the stacked sections to separate slightly along said joint and yet prohibit leakage while maintaining the sections in interlocked assembly.

30. The concrete form structure of claim 29 further characterized by the tie slots being positioned along upper and lower edges of each panel and on its opposite sides an equidistant modular arrangement so that the panels can be interchangeably used with one another.

31. The concrete form structure of claim 29 further charaterized by said castellation means on the upper and lower edges of the panel for interlocking the panel in engagement being modular on each section so that the sections can be interchangeably used with one another.

32. In a modular synthetic plastic concrete form structure, wherein the improvement comprises a pair of modular concrete impervious synethetic plastic forming panels each comprised of a series of opposed modular concrete forming sections stacked on top of another and also disposed in end-to-end relation, the sections each having longitudinally spaced male and female castellation means including castellation blocks and castellation block receiving cavities on its upper and lower edges along a joint between the sections for enabling superimposed sections to be press-fitted by hand pressure enabling the sections to be vertically stacked upon one another in interlocked assembly, the castellation means having concrete dam means for enabling the stacked sections to be slightly separated relative to one another without creating a leakage path for concrete to seep through the joint between the longitudinal extending secured edges of the panels, the dam means comprising a dam block integrally linked at opposite ends to said castellation means and a correspondingly shaped dam block cavity linked and connected to the castellation means which are positioned at opposite ends of the dam block, the dam block cavity being shaped for mated press-fitted engagement with the dam block when panels are disposed in superimposed assembly together, the castellation block having a greater height than the dam block to allow the stacked sections to separate slightly along said joint and yet prohibit leakage while the sections are maintained in interlocked assembly.

33. The form structure of claim 32 further characterized by said castellation means each comprising a main parallel sided block integral and a pair of mini-parallel side blocks projecting from opposite sides of the main parallel side blocks, which blocks all are integral and are spaced along a top edge of each panel, said castellation structure further comprising a series of cavities on a bottom edge of each panel having a configuration generally matching the shape of said blocks for nested press-fitted engagement together, the cavities when set on a foundation acting like suction cups to anchor the associated panel thereto.

* * * * *